US009505045B2

(12) United States Patent
Abe et al.

(10) Patent No.: US 9,505,045 B2
(45) Date of Patent: Nov. 29, 2016

(54) LEVELER EQUIPMENT AND SHEET MATERIAL FLATTENING METHOD

(71) Applicant: JP STEEL PLANTECH CO., Yokohama-shi (JP)

(72) Inventors: Keizo Abe, Yokohama (JP); Tomohiro Ishidou, Yokohama (JP)

(73) Assignee: JP STEEL PLANTECH CO., Yokohama-shi (JP)

( * ) Notice: Subject to any disclaimer, the term of this patent is extended or adjusted under 35 U.S.C. 154(b) by 0 days.

(21) Appl. No.: 14/648,458

(22) PCT Filed: Nov. 22, 2013

(86) PCT No.: PCT/JP2013/081550

§ 371 (c)(1),
(2) Date: May 29, 2015

(87) PCT Pub. No.: WO2014/084144

PCT Pub. Date: Jun. 5, 2014

(65) Prior Publication Data

US 2015/0306648 A1 Oct. 29, 2015

(30) Foreign Application Priority Data

Nov. 29, 2012 (JP) ..... 2012-260870

(51) Int. Cl.

| | |
|---|---|
| ***B21B 31/08*** | (2006.01) |
| ***B21D 1/02*** | (2006.01) |
| ***B21B 35/00*** | (2006.01) |
| ***B21D 1/05*** | (2006.01) |
| ***B21D 1/06*** | (2006.01) |

(52) U.S. Cl.

CPC ..... *B21B 31/08* (2013.01); *B21B 35/00* (2013.01); *B21D 1/02* (2013.01); *B21D 1/05* (2013.01); *B21D 1/06* (2013.01)

(58) Field of Classification Search

CPC ..... B21D 1/02; B21D 1/05; B21D 1/06; B21B 31/08; B21B 35/00

See application file for complete search history.

(56) References Cited

U.S. PATENT DOCUMENTS

| | | | | |
|---|---|---|---|---|
| 7,637,133 | B2 | 12/2009 | Buta | |
| 9,162,270 | B2 * | 10/2015 | Chazal | B21D 1/02 |
| 2014/0157850 | A1 * | 6/2014 | Buta | B21D 1/02 72/160 |

FOREIGN PATENT DOCUMENTS

| | | | |
|---|---|---|---|
| JP | 61-49611 | | 4/1986 |
| JP | 01-210121 | A | 8/1989 |
| JP | 05-169142 | A | 7/1993 |
| JP | 05169142 | A * | 7/1993 |
| JP | 2000-233221 | A | 8/2000 |
| JP | 2009-255148 | A | 11/2009 |

OTHER PUBLICATIONS

Machine translation and original of JP05169142A from JPIAT-PAT is attached.*

Extended European Search Report issued in European Patent Application No. 13858176.4 mailed on Jan. 8, 2016.

International Search Report and Written Opinion issued Feb. 18, 2014 in PCT/JP2013/081550 filed Nov. 22, 2013 (with partial English translation of Written Opinion).

* cited by examiner

*Primary Examiner* — Peter DungBa Vo
*Assistant Examiner* — John S Lowe
(74) *Attorney, Agent, or Firm* — Oblon, McClelland, Maier & Neustadt, L.L.P.

(57) ABSTRACT

Leveler equipment includes a leveler body, a first roll cassette for a roller leveler, and a second roll cassette for a tension leveler. The roller leveler is formed when the first roll cassette is attached to the leveler body, and the tension leveler is formed when the second roll cassette is attached to the leveler body.

6 Claims, 13 Drawing Sheets

LEVELER EQUIPMENT AND SHEET MATERIAL FLATTENING METHOD

TECHNICAL FIELD

The present invention relates to leveler equipment for and a sheet material flattening method of flattening metallic sheet material, such as steel sheets, titanium sheets, and aluminum sheets.

BACKGROUND ART

In the process of manufacturing metallic sheet material, such as steel sheets, titanium sheets, and aluminum sheets, the sheet material is subjected to rolling and cooling steps, in which deformation, such as warping and/or waving, occurs in the sheet material. In order to eliminate the deformation, such as warping and/or waving, and thereby to flatten the sheet material, a roller leveler, which includes a plurality of leveling rolls disposed on upper and lower sides in a staggered manner, is used (see Patent Document 1, for example).

In the roller leveler, sheet material to be flattened is passed through the roller leveler, with the upper leveling rolls being pressed toward the lower leveling rolls or the lower leveling rolls being pressed toward the upper leveling rolls, to repeatedly bend the sheet material, and thereby to planarize the warping and/or waving of the sheet material.

In such a roller leveler, the leveling range, in which the sheet material can be flattened by the roller leveler, is limited and therefore, in order to sufficiently flatten the sheet material having the maximum thickness within the requirement range, large-diameter leveling rolls that are strong enough to ensure safety are used and the roll pitch is correspondingly set. A roller leveler for thin sheets (thickness is about 6 mm or below) uses leveling rolls with a diameter of 70 mm, of which the roll pitch is 105 mm, for example.

When a thinner sheet material is leveled or flattened, a tension leveler is used that performs flattening of a continuous sheet material with the use of leveling rolls while applying tensile force to the continuous sheet material (see Patent Document 2, for example). The tension leveler repeatedly bends the sheet material with the use of small-diameter leveling rolls while applying tensile force to the sheet material, thereby planarizing the warping and/or waving of the sheet material.

PRIOR ART DOCUMENT

Patent Document

Patent Document 1: Japanese Patent Application Publication No. 2009-255148 (JP 2009-255148 A)

Patent Document 2: Japanese Patent Application Publication No. 2000-233221 (JP 2000-233221 A)

SUMMARY OF INVENTION

Problems to be Solved by the Invention

In recent years, demand for leveling or flattening of sheet material that is thinner and has a higher yield stress as compared to the conventional cases is increasing and a roller leveler that can flatten such sheet material is very useful. However, when the roll diameter of leveling rolls is set to a large diameter according to the maximum thickness within the requirement range and the roll pitch is correspondingly determined as described above, it becomes impossible to sufficiently level a sheet material that is thin and has a high yield stress. In order to sufficiently flatten a sheet material that is thinner and has a higher yield stress with the use of a roller leveler, it is required to set the diameter of leveling rolls to a small diameter and set the roll pitch correspondingly. However, when such a leveler is used to flatten thick sheet material, there is a possibility that rolls, bearings, etc., are damaged by the large flattening reaction force. Moreover, when the diameter of leveling rolls is set to a small diameter, the amount of torque transmitted will become insufficient in the case of a material having a high yield stress.

In addition, in the case of a thin sheet material, edge waves, center buckling, and lateral warps are more prone to occur as compared to the case of thick plates and it is difficult to eliminate these defects with the use of a roller leveler. On top of that, requirements on surface quality become more and more strict in recent years and therefore, there is a case where flattening is performed while spraying water-soluble liquid having a washing function and a rust prevention function. In some cases, however, this liquid causes a slip of the product, which in turn causes scratches on the surface of the product when a material having a high yield stress is flattened by the roller leveler.

For this reason, it is difficult to flatten a variety of sheet materials ranging from a sheet material that is thin and has a high yield stress to a sheet material that is relatively thick, that is, a sheet material that has a thickness of 6 mm, for example, with the use of a single roller leveler.

The present invention has been made under such circumstances and it is an object to provide leveler equipment and a sheet material flattening method, with which it is possible to sufficiently level or flatten sheet materials that are thin and have high yield stresses and are therefore difficult to flatten with the use of a roller leveler, while maintaining the performance of the roller leveler in leveling thick sheet materials.

Means for Solving the Problems

In order to solve the above problems, a first aspect of the present invention provides leveler equipment for flattening sheet material, including: a leveler body for flattening the sheet material, the leveler body having a pressing mechanism and a housing; a first roll cassette having upper and lower sets of roller-leveler leveling rolls, the first roll cassette being configured to be able to be attached to and detached from the leveler body; and a second roll cassette having upper and lower sets of tension-leveler leveling rolls, the second roll cassette being configured to be able to be attached to and detached from the leveler body, wherein: the first roll cassette and the second roll cassette are interchangeable; a roller leveler is formed when the first roll cassette is attached to the leveler body; and a tension leveler is formed when the second roll cassette is attached to the leveler body.

The leveler equipment according to the first aspect may further include a driving mechanism for driving the sets of roller-leveler leveling rolls and the sets of tension-leveler leveling rolls, wherein: the first roll cassette has a first power transmitting mechanism for transmitting driving force from the driving mechanism to the sets of roller-leveler leveling rolls; and the second roll cassette has a second power transmitting mechanism for transmitting driving force from the driving mechanism to the sets of tension-leveler leveling rolls. In this case, a reduction ratio of the first power transmitting mechanism may be higher than a reduction ratio of the second power transmitting mechanism. The second roll cassette may have intermediate roll sets provided on back sides of the sets of tension-leveler leveling rolls, and the second power transmitting mechanism may be configured to transmit the driving force from the driving mechanism to the intermediate rolls of the intermediate roll sets. A relation, $0.3D_{RL}<D_{TL}<0.6D_{RL}$, may be satisfied, where $D_{RL}$ is a diameter of the roller-leveler leveling rolls of the first roll cassette and $D_{TL}$ is a diameter of the tension-leveler leveling rolls of the second roll cassette.

The leveler equipment according to the first aspect may further include: a pair of bridle roll units provided on an entry side and a delivery side of the leveler body and each having bridle rolls; a controller configured to, when the roller leveler is formed, control the leveler equipment so as to flatten the sheet material by causing the pressing mechanism to apply pressing force to the sheet material via the upper and lower sets of roller-leveler leveling rolls in a state where the sheet material is passed between the upper and lower sets of roller-leveler leveling rolls of the first roll cassette without applying tensile force to the sheet material via the bridle rolls, and configured to, when the tension leveler is formed, control the leveler equipment so as to flatten the sheet material by causing the pressing mechanism to apply pressing force to the sheet material via the upper and lower sets of tension-leveler leveling rolls in a state where the sheet material is passed between the upper and lower sets of tension-leveler leveling rolls of the second roll cassette while applying tensile force to the sheet material via the bridle rolls.

The leveler equipment according to the first aspect may further include: a pair of bridle roll units provided on an entry side and a delivery side of the leveler body and each having bridle rolls, wherein at least one of the bridle roll units that is provided on the delivery side has a pinch roll function; and a controller configured to control the leveler equipment so as to flatten the sheet material in one of the following modes: a first mode, in which the first roll cassette is attached to the leveler body to form the roller leveler, and the sheet material is flattened by causing the pressing mechanism to apply pressing force to the sheet material via the sets of roller-leveler leveling rolls in a state where the sheet material is passed between the upper and lower sets of roller-leveler leveling rolls of the first roll cassette without applying tensile force to the sheet material via the bridle rolls and without activating the pinch roll function; a second mode, in which the first roll cassette is attached to the leveler body to form the roller leveler, and the sheet material is flattened by causing the pressing mechanism to apply pressing force to the sheet material via the sets of roller-leveler leveling rolls in a state where the sheet material is passed between the upper and lower sets of roller-leveler leveling rolls of the first roll cassette without applying tensile force to the sheet material via the bridle rolls while applying pulling force to the sheet material by activating the pinch roll function of the at least one of the bridle roll units that is provided on the delivery side; and a third mode, in which the second roll cassette is attached to the leveler body to form the tension leveler, and the sheet material is flattened by causing the pressing mechanism to apply pressing force to the sheet material via the sets of tension-leveler leveling rolls in a state where the sheet material is passed between the upper and lower sets of tension-leveler leveling rolls of the second roll cassette while applying tensile force to the sheet material via the bridle rolls.

In order to solve the above problems, a second aspect of the present invention provides a sheet material flattening method of flattening sheet material with the use of leveler equipment having: a leveler body for flattening the sheet material, the leveler body having a pressing mechanism and a housing; a first roll cassette having upper and lower sets of roller-leveler leveling rolls, the first roll cassette being configured to be able to be attached to and detached from the leveler body; and a second roll cassette having upper and lower sets of tension-leveler leveling rolls, the second roll cassette being configured to be able to be attached to and detached from the leveler body, the sheet material flattening method including: changing the first roll cassette attached to the leveler body to the second roll cassette to form a tension leveler; and changing the second roll cassette attached to the leveler body to the first roll cassette to form a roller leveler.

The sheet material flattening method according to the second aspect may further include, when the roller leveler is formed by attaching the first roll cassette to the leveler body, flattening the sheet material by causing the pressing mechanism to apply pressing force to the sheet material via the sets of roller-leveler leveling rolls in a state where the sheet material is passed between the upper and lower sets of roller-leveler leveling rolls of the first roll cassette without applying tensile force to the sheet material via the bridle rolls. The sheet material flattening method may further include, when the tension leveler is formed by attaching the second roll cassette to the leveler body, flattening the sheet material by causing the pressing mechanism to apply pressing force to the sheet material via the upper and lower sets of tension-leveler leveling rolls in a state where the sheet material is passed between the upper and lower sets of tension-leveler leveling rolls of the second roll cassette while applying tensile force to the sheet material via the bridle rolls.

In the sheet material flattening method according to the second aspect, the leveler equipment may further have a pair of bridle roll units provided on an entry side and a delivery side of the leveler body and each having bridle rolls, wherein at least one of the bridle roll units that is provided on the delivery side has a pinch roll function, wherein the sheet material flattening method further includes flattening the sheet material in one of the following modes that is selected according to thickness and yield stress of the sheet material: a first mode, in which the first roll cassette is attached to the leveler body to form the roller leveler, and the sheet material is flattened by causing the pressing mechanism to apply pressing force to the sheet material via the sets of roller-leveler leveling rolls in a state where the sheet material is passed between the upper and lower sets of roller-leveler leveling rolls of the first roll cassette without applying tensile force to the sheet material via the bridle rolls and without activating the pinch roll function; a second mode, in which the first roll cassette is attached to the leveler body to form the roller leveler, and the sheet material is flattened by causing the pressing mechanism to apply pressing force to the sheet material via the sets of roller-leveler leveling rolls in a state where the sheet material is passed between the upper and lower sets of roller-leveler leveling rolls of the first roll cassette without applying tensile force to the sheet material via the bridle rolls while applying pulling force to the sheet material by activating the pinch roll function of the at least one of the bridle roll units that is provided on the delivery side; and a third mode, in which the second roll cassette is attached to the leveler body to form the tension leveler, and the sheet material is flattened by causing the pressing mechanism to apply pressing force to the sheet material via the sets of tension-leveler leveling rolls in a state where the sheet material is passed between the upper and lower sets of tension-leveler leveling rolls of the second roll cassette while applying tensile force to the sheet material via the bridle rolls.

Advantageous Effects of Invention

According to the present invention, a first roll cassette including upper and lower sets of roller-leveler leveling rolls and a second roll cassette including upper and lower sets of tension-leveler leveling rolls are configured to be able to be attached to and detached from the leveler body, wherein a roller leveler is formed when the first roll cassette is attached to the leveler body, and a tension leveler is formed when the second roll cassette is attached to the leveler body. Accordingly, it is possible to selectively use the roller leveler and the tension leveler according to the thickness and yield stress of the sheet material. In particular, it is possible to perform flattening of sheet material in the following three modes: a first mode, in which the first roll cassette is attached to the leveler body to form the roller leveler and the sheet material is flattened without applying tensile force to the sheet material by the bridle rolls of the pair of bridle roll units and without activating the pinch roll function; a second mode, in which the first roll cassette is attached to the leveler body to form the roller leveler and the sheet material is flattened while applying pulling force to the sheet material by activating the pinch roll function of one of the bridle roll units that is provided on the delivery side without applying tensile force to the sheet material by the bridle rolls of the bridle roll units; and a third mode, in which the second roll cassette is attached to the leveler body to form the tension leveler, and the sheet material is flattened while applying tensile force to the sheet material by the bridle rolls of the bridle roll units. Accordingly, it is possible to select from these modes according to the thickness and yield stress of the sheet material, so that it is possible to perform leveling or flattening of a very wide range of sheet materials in terms of thickness and yield stress with the use of a single piece of equipment.

EMBODIMENTS FOR CARRYING OUT THE INVENTION

Embodiments of the present invention will now be described with reference to the accompanying drawings.

Figure 1:
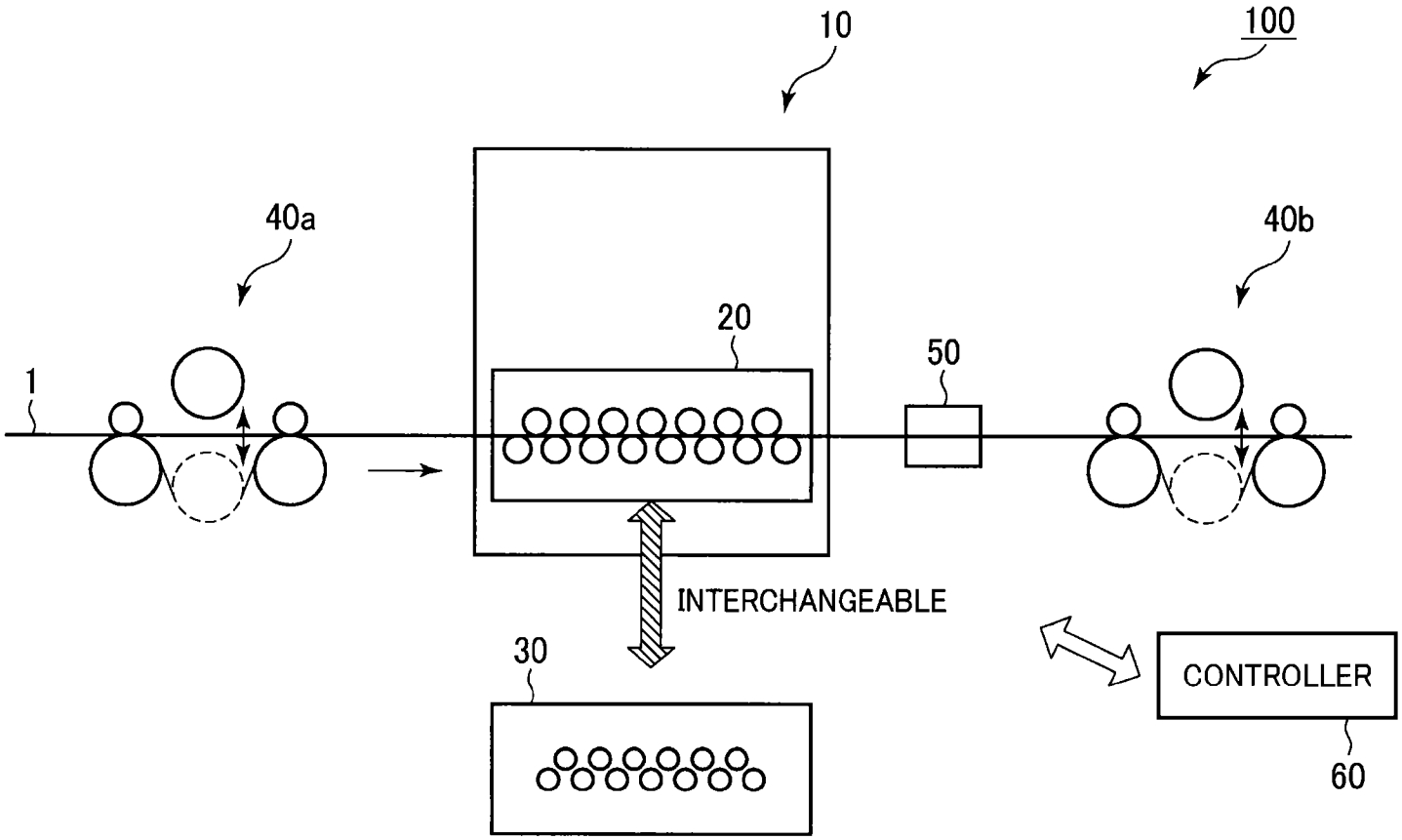
FIG. 1 is a schematic configuration diagram showing leveler equipment according to an embodiment of the present invention.

FIG. 1 is a schematic configuration diagram showing leveler equipment according to an embodiment of the present invention. The leveler equipment 100 according to this embodiment performs leveling or flattening of a continuous sheet material 1 unreeled from a pay-off reel (not shown). The leveler equipment 100 includes: a leveler body 10; a first roll cassette 20 configured to be able to be attached to and detached from the leveler body 10 and having upper and lower sets of roller-leveler leveling rolls; a second roll cassette 30 configured to be able to be attached to and detached from the leveler body 10 and having upper and lower sets of tension-leveler leveling rolls; and bridle roll units 40*a* and 40*b* having bridle rolls, which are provided on the upstream side and the downstream side of the leveler body 10. FIG. 1 shows a state, in which the first roll cassette 20 is attached to the leveler body 10. Operation of each component of the leveler equipment 100 is controlled by a controller 60. Examples of the sheet material 1 include metal sheets, such as steel sheets, titanium sheets, and aluminum sheets.

The leveler body 10 includes frames and pressing mechanisms. As shown in FIG. 1, a roller leveler is formed when the first roll cassette 20 is attached to the leveler body 10. In this case, the pressing mechanisms of the leveler body 10 apply pressing force to the sheet material 1 via the upper and lower sets of leveling rolls in a state where the sheet material 1 is passed between the upper and lower sets of leveling rolls of the first roll cassette 20 without applying tensile force to the sheet material 1 via the bridle rolls, whereby the leveler body 10 functions as a roller leveler. Note that, as described later, each of the bridle roll units 40*a* and 40*b* has a pinch roll function and it is therefore possible to perform flattening of the sheet material 1 while applying pulling force to the sheet material 1 by activating the pinch roll function of the bridle roll unit on the delivery side (bridle roll unit 40*b* in this embodiment) when the leveler body 10 is used as the roller leveler. In other words, when the leveler body 10 is used as a roller leveler, it is possible to perform flattening of the sheet material 1 in two modes, in one of which the pinch roll function is not activated, in the other of which the pinch roll function is activated. When the mode, in which the leveler body 10 functions as a tension leveler, is added, it is possible to perform flattening in three modes in total.

The first roll cassette 20 and the second roll cassette 30 can be attached to and detached from the leveler body 10 and these are therefore interchangeable. Specifically, when the first roll cassette 20 is detached from the leveler body 10 and the second roll cassette 30 is attached to the leveler body 10, a tension leveler is formed. In this case, the pressing mechanisms of the leveler body 10 apply pressing force to the sheet material 1 via the upper and lower sets of leveling rolls in a state where the sheet material 1 is passed between the upper and lower sets of leveling rolls of the second roll cassette 30 while applying tensile force to the sheet material 1 via the bridle rolls as shown by the broken line, whereby the leveler body 10 functions as a tension leveler.

When the roller leveler and/or the tension leveler configured as described above perform(s) leveling of the sheet material 1 while supplying liquid, which is obtained by adding a small amount of oil to water, for example, it is preferable that an air blower 50 for drying the sheet material 1 be installed on the downstream side of the leveler body 10 with respect to the sheet material passing direction.

Figure 2:
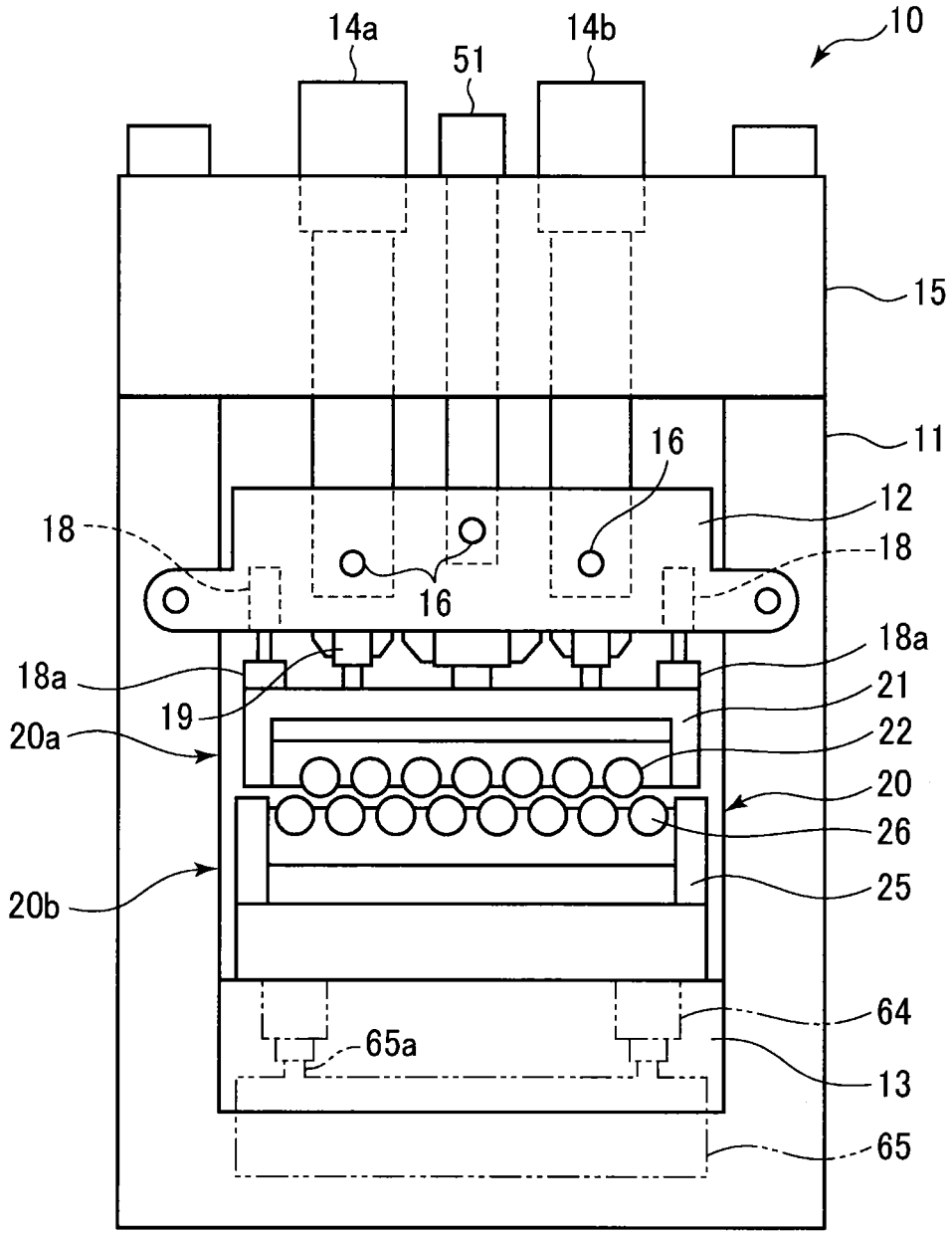
FIG. 2 is a front view showing a state where a first roll cassette is attached to a leveler body.
Figure 3:
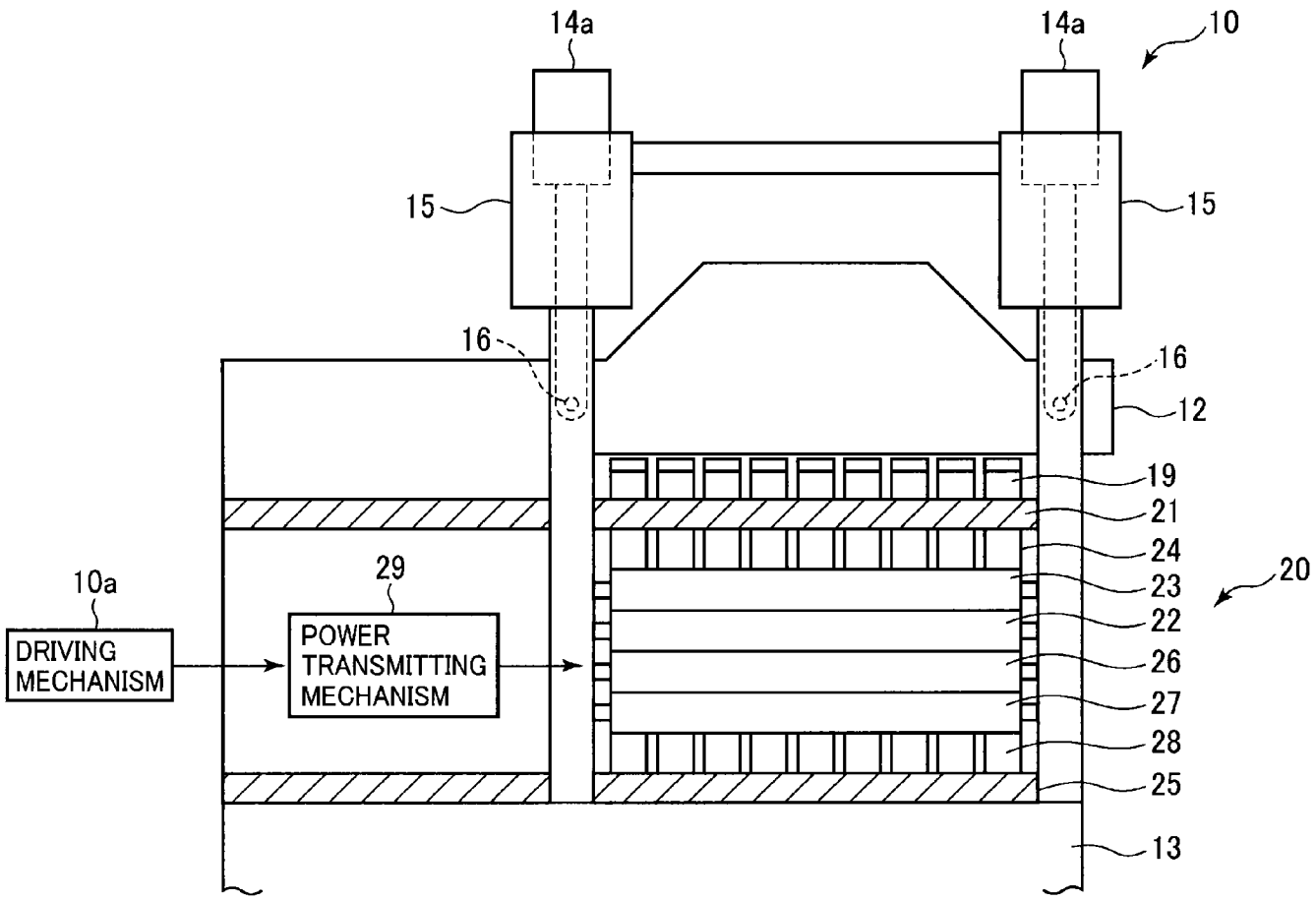
FIG. 3 is a side view showing the state where the first roll cassette is attached to the leveler body.
Figure 4:
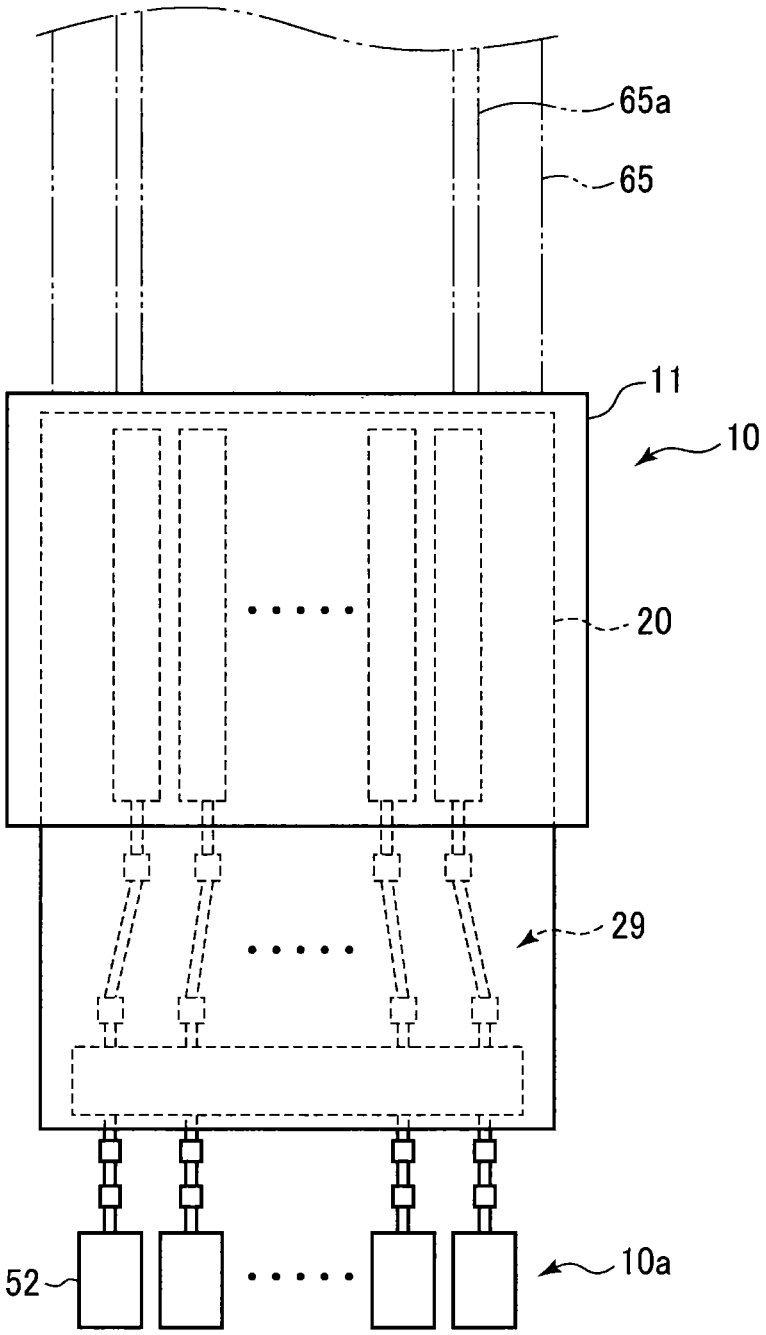
FIG. 4 is a plan view showing the state where the first roll cassette is attached to the leveler body.

Next, a description will be given of a state where the first roll cassette 20 is attached to the leveler body 10 to form a roller leveler. FIG. 2 is a front view showing a state, in which the first roll cassette 20 is attached to the leveler body 10. FIGS. 3 and 4 are a side view and a plan view of this state, respectively.

The leveler body 10 includes: a housing 11; a casing 15 provided at an upper portion of the housing 11; an upper frame 12 provided under the casing 15 in the housing 11; and a lower frame 13 provided at a lower portion of the housing 11. The leveler body 10 includes a driving mechanism 10a fixed outside the housing 11 and having motors 52 etc. for driving the rolls of the first roll cassette 20 and the second roll cassette 30. In the case of this example, in which the first roll cassette 20 is attached, driving force generated by the driving mechanism 10*a* is transmitted through a power transmitting mechanism 29 provided in the first roll cassette 20. The first roll cassette 20 is attached to the leveler body 10 so as to protrude from the housing 11 of the leveler body 10 and the power transmitting mechanism 29 is provided in the protruding part of the first roll cassette 20. Note that the upper frame 12 and the lower frame 13 are also provided so as to protrude from the housing 11 similarly to the power transmitting mechanism 29.

The pressing cylinders 14*a* and 14*b*, which function as pressing mechanisms for applying pressing force to flatten the sheet material 1, are housed in the upper casing 15 of the housing 11. The pressing cylinders 14*a* and 14*b*, each including two cylinders, are provided at two ends in the width direction of the sheet material 1 (see FIG. 3, in which, however, only the pressing cylinders 14*a* are shown). Lift cylinders 51 as well as the pressing cylinders 14*a* and 14*b* are housed in the casing 15. The pressing cylinders 14*a* and 14*b* and the lift cylinders 51 are connected to the upper frame 12 via connection portions 16, which are provided at end portions of pistons of the pressing cylinders 14*a* and 14*b* and the lift cylinders 51.

Grip cylinders 18 for holding the roll cassette 20 or 30 are housed in both sides of the upper frame 12 (the first roll cassette 20 is held in this example).

A plurality of hydraulic wedges 19 (nine in this embodiment) are arranged in the sheet width direction on the lower side of the upper frame 12. The hydraulic wedges 19 are controlled based on the values detected by predetermined sensors so as to minimize deflection of the upper frame 12 and the lower frame 13, and compressive deformation of the pressing cylinders 14*a* and 14*b*, the rolls of the first cassette unit 20, the roll frames, etc. The pressure control system is not limited to the hydraulic wedge type and examples of the pressure control system include systems of electrically driven type and hydraulic crowning cylinder type.

The leveler body 10 has a space, in which the roll cassette 20 or 30 is installed, under the hydraulic wedges 19. In this example, the first roll cassette 20 is installed in this space.

As shown in FIG. 2, the first roll cassette 20 has an upper cassette 20*a* and a lower cassette 20*b*. The upper cassette 20*a* has an upper roll frame 21 and a plurality of elongated upper leveling rolls 22 (seven in this embodiment). The lower cassette 20*b* has a lower roll frame 25 and a plurality of elongated lower leveling rolls 26 (eight in this embodiment). The upper leveling rolls 22 and the lower leveling rolls 26 are arranged in a staggered manner and constitute an upper set of leveling rolls and a lower set of leveling rolls, respectively. Grip cylinder receptacles 18*a* to be connected with the grip cylinders 18 attached to the upper frame 12 are attached at both sides of the upper roll frame 21.

Since the first roll cassette 20 functions as the roller leveler, large-diameter rolls are used as the upper leveling rolls 22 and the lower leveling rolls 26. For example, the diameter of the rolls is 70 mm and the roll pitch is 105 mm. The lower roll frame 25 is provided with wheels 64 to move the first roll cassette 20 when the first roll cassette 20 is attached or detached.

When the first roll cassette 20 is attached, the upper cassette 20*a* and the lower cassette 20*b* are positioned by appropriate positioning members.

A rail base 65, on which rails 65*a* are provided, is mounted on the lower frame 13 of the leveler body 10. The rail base 65 extends in the direction perpendicular to the paper plane of FIG. 2. When the first roll cassette 20 and the second roll cassette 30 are changed from one to the other, these cassettes are moved along the rails 65*a* on the rail base 65 via the wheels 64.

Figure 5:
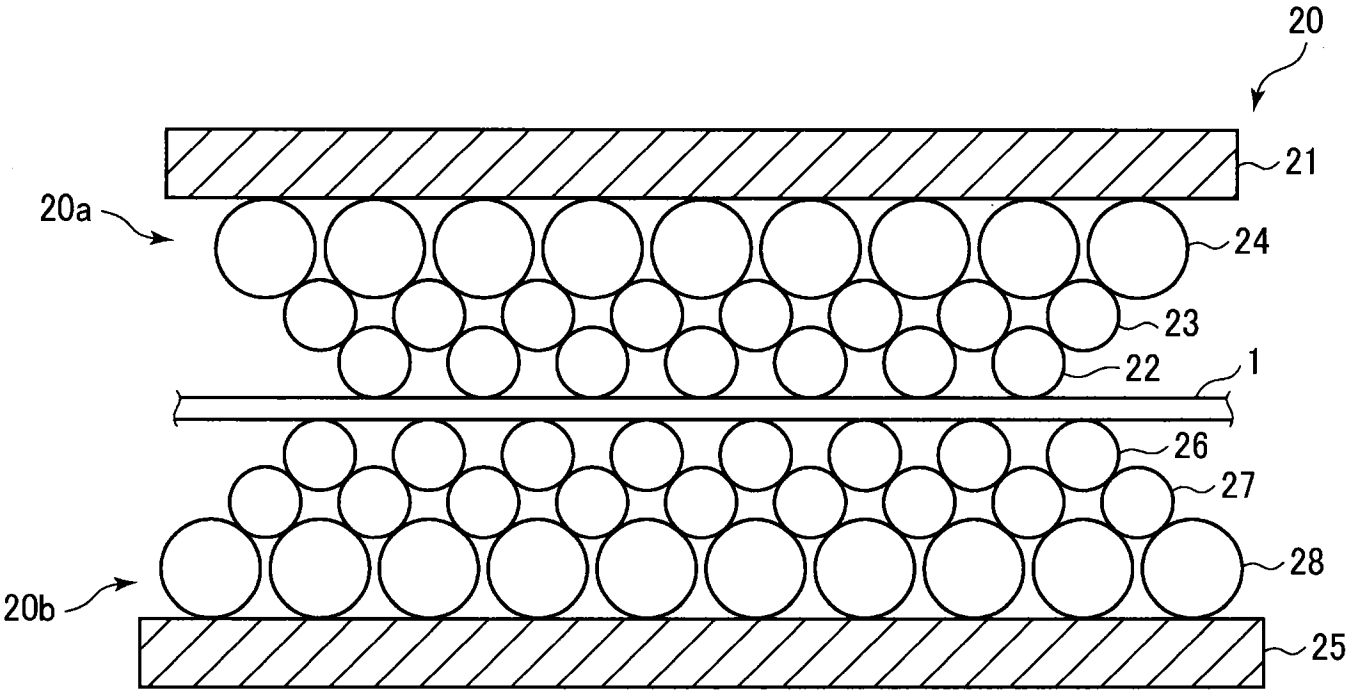
FIG. 5 is a front view specifically showing an interior of the first roll cassette.
Figure 6:
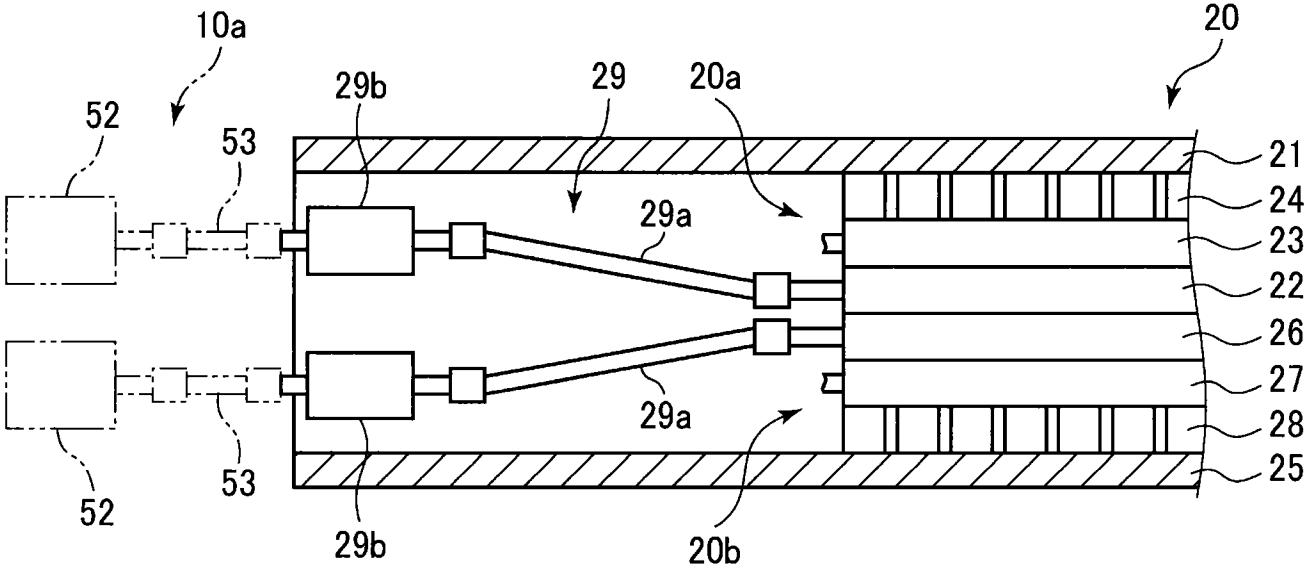
FIG. 6 is a side view specifically showing the interior of the first roll cassette.

FIGS. 5 and 6 are a front view and a side view, respectively, showing a detailed configuration of the first roll cassette 20. Elongated, upper intermediate rolls 23 are provided between the upper roll frame 21 and the upper leveling rolls 22, and a plurality of short upper backup rolls 24 for backing up the intermediate rolls 23 are disposed. The upper leveling rolls 22, the upper intermediate rolls 23, and the upper backup rolls 24 are provided so as to be supported by the upper roll frame 21.

Elongated, lower intermediate rolls 27 are provided between the lower roll frame 25 and the lower leveling rolls 26 and a plurality of short lower backup rolls 28 for backing up the intermediate rolls 27 are disposed. The lower leveling rolls 26, the lower intermediate rolls 27, and the lower backup rolls 28 are provided so as to be supported by the lower roll frame 25. The diameter of the upper intermediate rolls 23 and the lower intermediate rolls 27 is 70 mm, for example, and the diameter of the upper backup rolls 24 and the lower backup rolls 28 is 100 mm, for example.

As shown in FIG. 6, the power transmitting mechanism 29 includes universal joints 29*a* connected to the shafts of the upper leveling rolls 22 and the lower leveling rolls 26, and a pinion nest 29*b* connected to the universal joints 29*a*. The first roll cassette 20 includes the power transmitting mechanism 29. The first roll cassette 20 is attached so that the upper roll frame 21 and the lower roll frame 25 protrude from the housing 11 of the leveler body 10, and the power transmitting mechanism 29 is housed in the portion of the first roll cassette 20 protruding from the housing 11 (FIGS. 3 and 4). The driving mechanism 10*a* of the leveler body 10 includes a plurality of motors 52 for driving the upper and lower leveling rolls 22 and 26, and universal joints 53 connected to the motors 52. The pinion nest 29*b* of the power transmitting mechanism 29 can be attached to and detached from the universal joints 53 of the driving mechanism 10*a*. When the first roll cassette 20 is attached to the leveler body 10, driving force generated by the motors 52 of the driving mechanism 10*a* is transmitted to the upper leveling rolls 22 and the lower leveling rolls 26 through the universal joints 53, and the pinion nest 29*b* and the universal joints 29*a* of the power transmitting mechanism 29. When the first roll cassette 20 is detached, the power transmitting mechanism 29 is also detached along with the first roll cassette 20.

Figure 7:
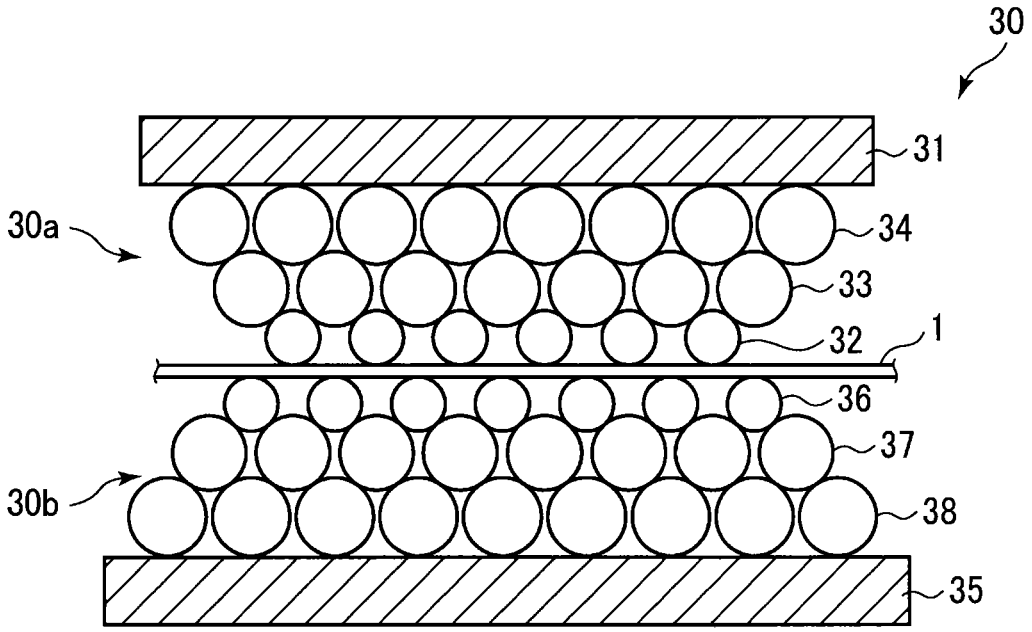
FIG. 7 is a front view specifically showing an interior of the second roll cassette.
Figure 8:
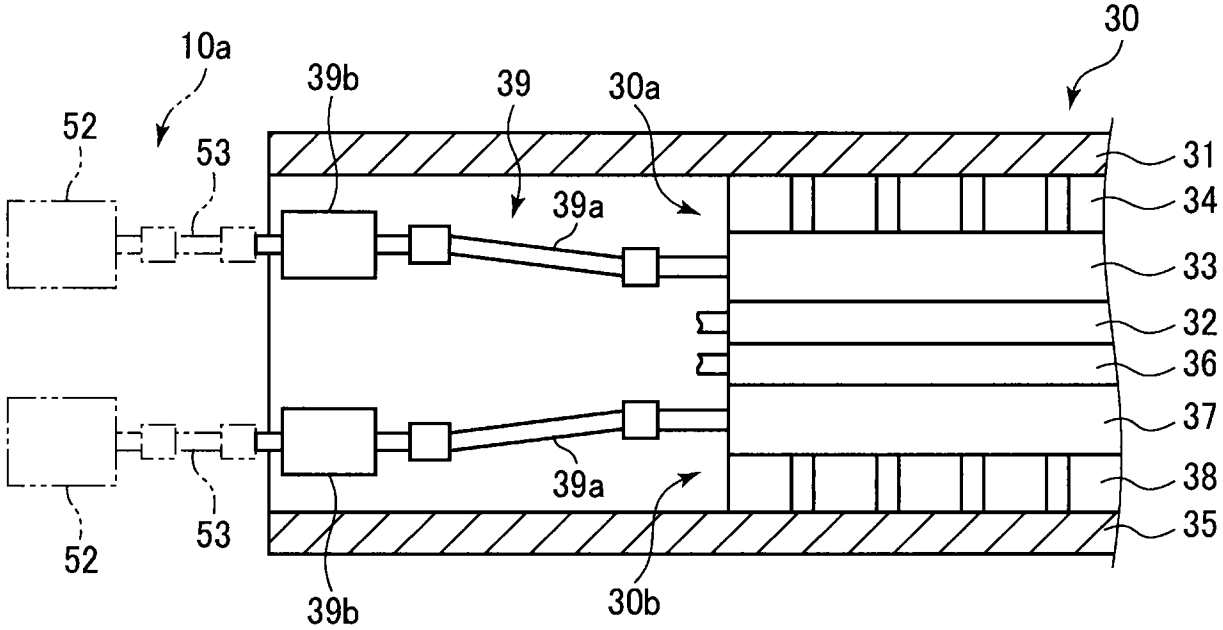
FIG. 8 is a side view specifically showing the interior of the second roll cassette.

Next, the second roll cassette 30 will be described. FIGS. 7 and 8 are a front view and a side view, respectively, showing a detailed configuration of the second roll cassette 30. As shown in these figures, the second roll cassette 30 is basically the same as the first roll cassette 20 in configuration, having an upper cassette 30*a* and a lower cassette 30*b*. The upper cassette 30*a* has an upper roll frame 31 and a plurality of elongated, upper leveling rolls 32. The lower cassette 30*b* has a lower roll frame 35 and a plurality of elongated, lower leveling rolls 36. The upper leveling rolls 32 and the lower leveling rolls 36 are arranged in a staggered manner and constitute an upper set of leveling rolls and a lower set of leveling rolls, respectively. Since the second roll cassette 30 is used to form a tension leveler, small-diameter rolls are used as the upper leveling rolls 32 and the lower leveling rolls 36. For example, the diameter of the rolls is 30 mm and the roll pitch is 80 mm. The numbers of the upper leveling rolls 32 and the lower leveling rolls 36 may be smaller than those of the upper leveling rolls 22 and the lower leveling rolls 26 of the first roll cassette 20, respectively. In this example, the number of the upper leveling rolls 32 is six and the number of the lower leveling rolls 36 is seven.

As in the case of the first roll cassette 20, elongated, upper intermediate rolls 33 are provided between the upper roll frame 31 and the upper leveling rolls 32 and a plurality of short upper backup rolls 34 for backing up the upper intermediate rolls 33 are disposed. The upper leveling rolls 32, the upper intermediate rolls 33, and the upper backup rolls 34 are supported by the upper roll frame 31. Elongated, lower intermediate rolls 37 are provided between the lower roll frame 35 and the lower leveling rolls 36, and a plurality of short lower backup rolls 38 for backing up the lower intermediate rolls 37 are disposed. The lower leveling rolls 36, the lower intermediate rolls 37, and the lower backup rolls 38 are supported by the lower roll frame 35. The diameter of the upper intermediate rolls 33 and the lower intermediate rolls 37 is 65 mm, for example, and the diameter of the upper backup rolls 34 and the lower backup rolls 38 is 75 mm, for example.

When the second roll cassette 30 is attached to the leveler body 10, the upper cassette 30*a* and the lower cassette 30*b* are positioned by appropriate positioning members.

As in the case of the first roll cassette 20, grip cylinder receptacles are attached on the top of the upper roll frame 31 and the lower roll frame 35 is provided with wheels to move the second roll cassette 30 when the second roll cassette 30 is attached or detached.

As shown in FIG. 8, the second roll cassette 30 includes a power transmitting mechanism 39 having universal joints 39*a* connected to the shafts of the upper intermediate rolls 33 and the lower intermediate rolls 37, and a pinion nest 39*b* connected to the universal joints 39*a*. As in the case of the first roll cassette 20, the second roll cassette 30 is attached so that the upper roll frame 31 and the lower roll frame 35 protrude from the housing 11 of the leveler body 10, and the power transmitting mechanism 39 is housed in the portion of the second roll cassette 30 protruding from the housing 11. The pinion nest 39*b* of the power transmitting mechanism 39 can be attached to and detached from the universal joints 53 of the driving mechanism 10*a*. Accordingly, when the second roll cassette 30 is attached to the leveler body 10, driving force generated by the motors 52 of the driving mechanism 10*a* is transmitted to the upper intermediate rolls 33 and the lower intermediate rolls 37 through the universal joints 53, and the pinion nest 39*b* and the universal joints 39*a* of the power transmitting mechanism 39. When the second roll cassette 30 is detached, the power transmitting mechanism 39 is also detached along with the second roll cassette 30.

In many cases, the leveling rolls 32 and 36 of the second roll cassette 30 for the tension leveler have a small diameter, so that it is difficult to attach the universal joints to the leveling rolls 32 and 36. In such a case, it is effective to drive the intermediate rolls 33 and 37 in the second roll cassette 30 as in this embodiment. In general, it is possible to increase the sheet feed speed in a tension leveler, in which a thinner sheet is flattened, as compared to the case of roller levelers and therefore, in view of process efficiency, it is preferable to increase the sheet feed speed when the tension leveler is formed. For this reason, it is preferable that the reduction ratio of the power transmitting mechanism 39 be lower than the reduction ratio of the power transmitting mechanism 29.

In the above description, the diameter of the leveling rolls 22 and 26 of the first roll cassette 20 for the roller leveler is 70 mm and the diameter of the leveling rolls 32 and 36 of the second roll cassette 30 for the tension leveler is 30 mm, for example. There is a preferable range of the ratio of these diameters. Specifically, it is preferable that the relation, $0.3D_{RL}<D_{TL}<0.6D_{RL}$, be satisfied, where $D_{RL}$ is the diameter of the leveling rolls 22 and 26 and $D_{TL}$ is the diameter of the leveling rolls 32 and 36.

Figure 9:
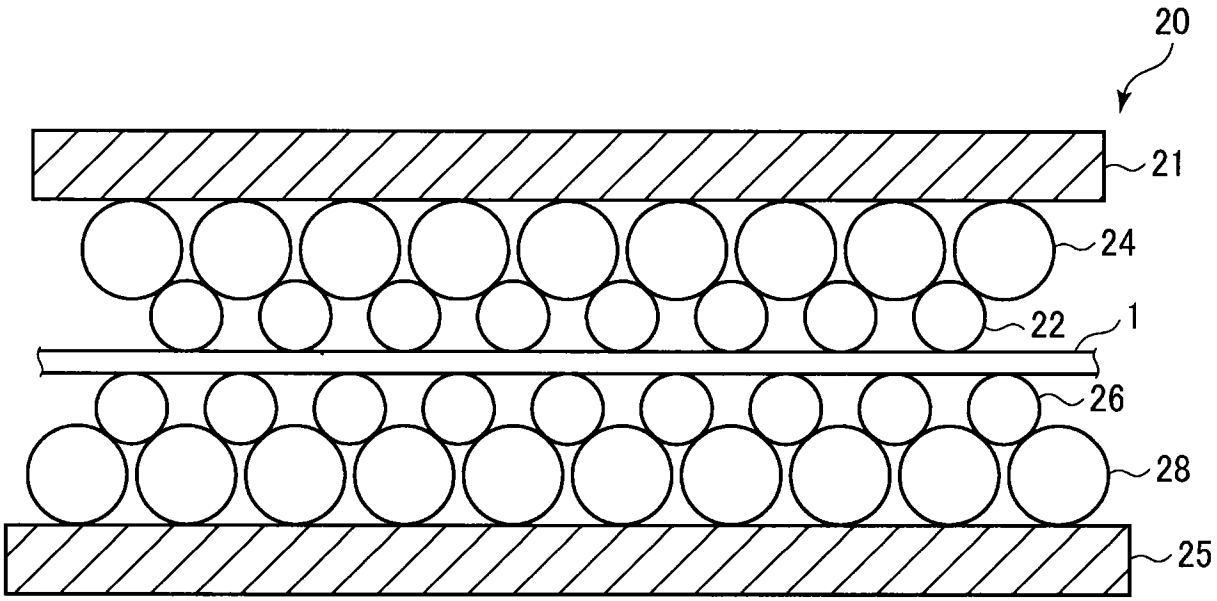
FIG. 9 is a front view showing another example of a first roll cassette.
Figure 10:
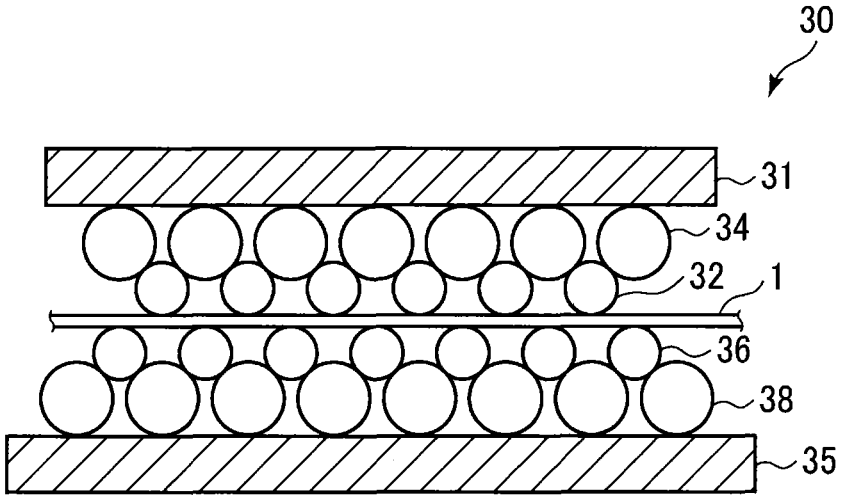
FIG. 10 is a front view showing another example of a second roll cassette.

As shown in FIGS. 9 and 10, the first roll cassette 20 and the second roll cassette 30 may be such that the intermediate rolls are not provided and the backup rolls 24 and 28 and the backup rolls 34 and 38 are provided on the back sides of the leveling rolls 22 and 26 and the leveling rolls 32 and 36, respectively.

Next, details of the bridle roll units 40*a* and 40*b* will be described.

Figure 11:
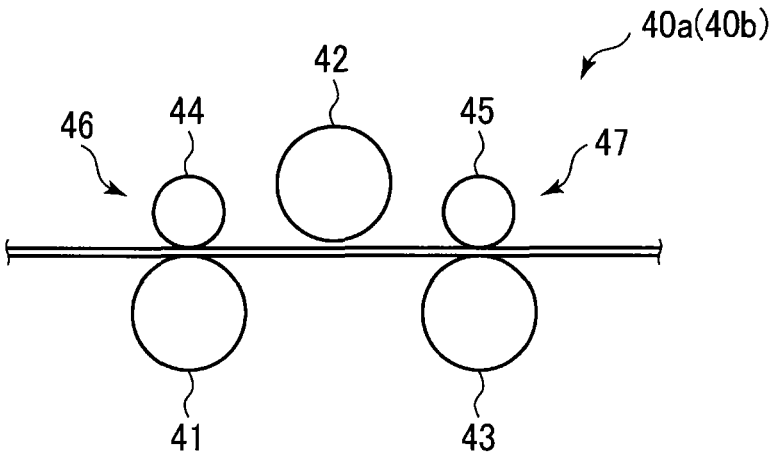
FIG. 11 is a schematic configuration diagram showing a bridle roll unit, showing a state where bridle rolls are not activated.
Figure 12:
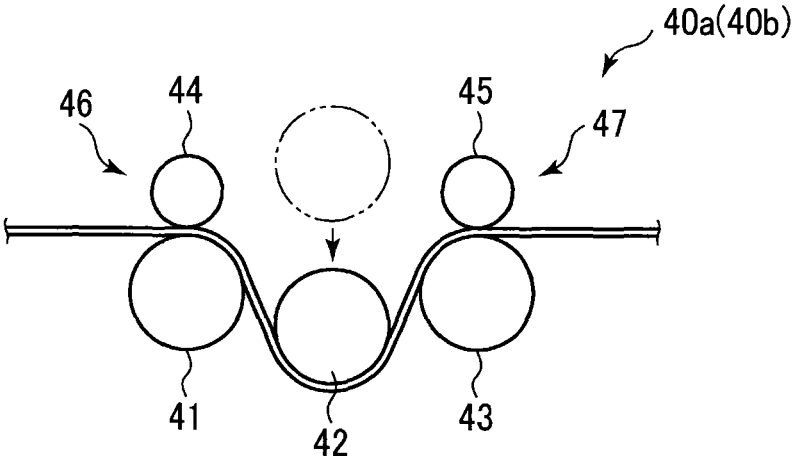
FIG. 12 is a schematic configuration diagram showing the bridle roll unit, showing a state where bridle rolls are activated.

FIGS. 11 and 12 are schematic configuration diagrams showing the bridle roll units 40*a* and 40*b*. FIG. 11 shows a state, in which no tensile force is applied to the sheet material 1 by the bridle rolls. FIG. 12 shows a state, in which tensile force is applied to the sheet material 1 by the bridle rolls. As shown in these figures, each of the bridle roll units 40*a* and 40*b* has three bridle rolls 41, 42, and 43, and the center bridle roll 42 is configured to be able to move vertically. The sheet material 1 is wound around the bridle rolls 41, 42, and 43 and tensile force is applied to the sheet material 1 when the bridle roll 42 is lowered from a raised position, at which no tensile force is applied to the sheet material 1, as shown in FIG. 11 to a lowered position as shown in FIG. 12. The bridle rolls 41 and 43 are fixed below the path of the sheet material 1. The bridle roll 42 functions as a feed roll when the bridle roll 42 is positioned at the raised position.

Pressing rolls 44 and 45 for pressing the sheet material 1 are provided above the bridle rolls 41 and 43. The bridle roll 41 and the pressing roll 44 constitute a pinch roll 46, and the bridle roll 43 and the pressing roll 45 constitute a pinch roll 47. Each of the pressing rolls 44 and 45 has a hydraulic servo mechanism and it is possible to control pressing force to press the sheet material 1 via the hydraulic servo mechanisms.

When the first roll cassette 20 is attached to the leveler body 10 to form the roller leveler, each of the center bridle rolls 42 of the bridle roll units 40*a* and 40*b* is positioned at the raised position to perform flattening of the sheet material 1 without applying tensile force to the sheet material 1. In this case, it is possible to select from the following two modes: a first mode, in which flattening of the sheet material 1 is performed by bending the sheet material 1 with the use of the leveling rolls 22 and 26; and a second mode, in which the pinch rolls 46 and 47 (pressing rolls 44 and 45) of the bridle roll unit 40*b* on the delivery side are activated to apply pulling force (pressing force) to the sheet material 1.

On the other hand, when the second roll cassette 30 is attached to the leveler body 10 to form the tension leveler, each of the center bridle rolls 42 of the bridle roll units 40*a* and 40*b* is positioned at the lowered position to perform flattening of the sheet material 1 by bending the sheet material 1 with the use of the leveling rolls 32 and 36 while applying tensile force to the sheet material 1. Applying the pressing force to the sheet material 1 by lowering the pressing rolls 44 and 45 to make the pinch rolls 46 and 47 work makes it possible to increase the tensile force applied to the sheet material 1. The pressing force applied by the pressing rolls 44 and 45 is controlled by the hydraulic serve mechanisms so as to prevent unnecessarily large force from being applied.

Next, a description will be given of operation performed when the sheet material 1 is flattened by the leveler equipment 100 configured as described above.

When the leveler equipment 100 is used as the roller leveler, the first roll cassette 20 is attached to the leveler body 10 to form the roller leveler. In this case, the leveler equipment 100 is brought into a state, in which each of the center bridle rolls 42 of the bridle roll units 40*a* and 40*b* is positioned at the raised position and tensile force is therefore not applied to the sheet material 1. Then, the sheet material 1 paid off from the pay-off reel (not shown) is transferred in the direction indicated by the arrow in FIG. 1 to flatten the sheet material 1 with the use of the roller leveler formed by the leveler body 10 and the first roll cassette 20.

In this roller leveler, it is possible to perform flattening of the sheet material 1 in the two modes, the first mode and the second mode. When the sheet material 1 is flattened in the first mode, the sheet material 1 is inserted between the upper leveling rolls 22 and the lower leveling rolls 26 of the first roll cassette 20 attached to the leveler body 10, and pressing force is applied to the sheet material 1 between the upper leveling rolls 22 and the lower leveling rolls 26 by the pressing cylinders 14*a* and 14*b* to bend the sheet material 1 while transferring the sheet material 1 by driving the upper leveling rolls 22 and the lower leveling rolls 26 by the motors 52 of the driving mechanism 10*a* via the universal joints 53, and the pinion nest 29*b* and the universal joints 29*a* of the power transmitting mechanism 29, without applying tensile force to the sheet material 1 via the bridle roll units 40*a* and 40*b* and without activating the pinch roll function. Accordingly, in principle, only the amount of pressing by the leveling rolls 22 and 26 determines the flattening result. The upper limit of the pressing amount for the sheet material 1 is determined by the torque of the leveling rolls 22 and 26.

When flattening is performed in the first mode, the sheet material 1 that is thin and has a high yield stress requires large pressing amount. However, there is a limit to the pressing amount. For this reason, in the second mode, the pinch rolls 46 and 47 of the delivery-side bridle roll unit 40*b* press the sheet material 1 to pull the sheet material 1. This makes it possible to help feed the sheet material 1, that is, to compensate for the lack of torque of the leveling rolls 22 and 26, which in turn makes it possible to increase the pressing amount of the leveling rolls 22 and 26. Consequently, it is made possible to level or flatten the sheet material 1 that is thinner and has a higher yield stress as compared to the case of the first mode. The pressing force is controlled by the hydraulic servo mechanisms for the pressing rolls 44 and 45.

When the sheet material 1 is further thinner and has a higher yield stress, it becomes difficult to sufficiently flatten the sheet material 1 with the use of the roller leveler even in the second mode. Moreover, in the case of thin sheet material, edge waves, center buckling, and lateral warps are more prone to occur as compared to the case of thick plates and it is difficult to eliminate these defects with the use of a roller leveler.

In such a case, the first roll cassette 20 is detached from the leveler body 10, the second roll cassette 30 is attached thereto, and the bridle rolls of the bridle roll units 40*a* and 40*b* are activated to apply tensile force to the sheet material 1, whereby a tension leveler is formed to flatten the sheet material 1 in a third mode.

Figure 13A:
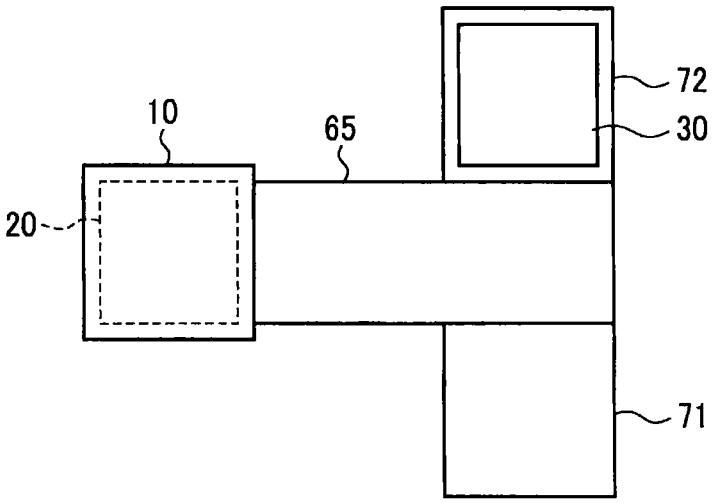
FIGS. 13A, 13B and 13C are diagrams for explaining operation for the change between the first roll cassette and the second roll cassette.
Figure 13B:
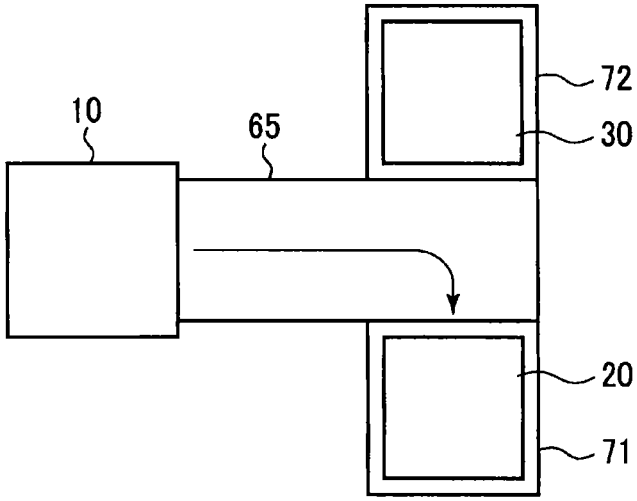
Figure 13C:
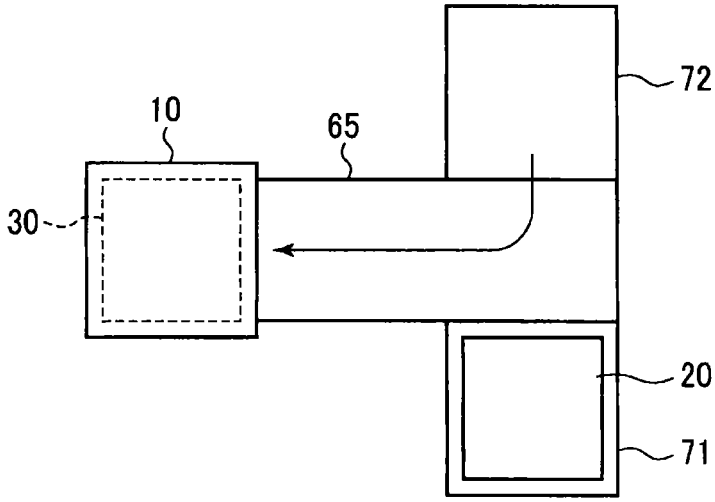

Operation for the change from the first roll cassette 20 to the second roll cassette 30 will be described with reference to FIG. 13. In FIG. 13, rails are not shown for the sake of simplification. When the first roll cassette 20 is in the leveler body 10 and the second roll cassette 30 is present at a standby position 72 as shown in FIG. 13A, the upper cassette 20*a* is put on the lower cassette 20*b* of the first roll cassette 20 and the first roll cassette 20 is moved on the rails of the rail base 65 via the wheels with the use of an appropriate movement means to a standby position 71 as shown in FIG. 13B. As shown in FIG. 13C, the second roll cassette 30 is moved from the standby position 72 on the rails of the rail base 65 with the use of an appropriate movement means and attached to a predetermined position in the body 10. In this way, it is made possible to perform leveling by the tension leveler using the second roll cassette 30.

When the sheet material 1 is flattened in the third mode by the tension leveler formed by the leveler body 10 and the second roll cassette 30, the sheet material 1 is inserted between the upper leveling rolls 32 and the lower leveling rolls 36 of the second roll cassette 30, and the pressing cylinders 14*a* and 14*b* apply pressing force to the sheet material 1 while the upper intermediate rolls 33 and the lower intermediate rolls 37 are driven by the motors 52 of the driving mechanism 10*a* via the universal joints 53, and the pinion nest 39*b* and the universal joints 39*a* of the driving power transmitting mechanism 39, with the center bridle rolls 42 of the bridle roll units 40*a* and 40*b* lowered to the lowered position to apply tensile force to the sheet material 1. In this way, the sheet material 1 is flattened by elongation and bending. During this process, it is possible to increase the tensile force by applying pressing force to the sheet material 1 via the pressing rolls 44 and 45. The pressing force applied by the pressing rolls 44 and 45 is controlled by the hydraulic serve mechanisms so as to prevent unnecessarily large force from being applied.

In the third mode using the tension leveler, the sheet material 1 is helped to become in close contact with the leveling rolls 32 and 36 by applying tensile force to the sheet material 1 via the bridle roll units 40*a* and 40*b*. Moreover, since the small-diameter rolls are used, it is possible to increase the pressing amount to increase the part of the sheet material 1 that is wound around the leveling rolls 32 and 36 as compared to the case of the roller leveler. As a result, it is made possible to flatten the sheet material that is thin and has a high yield stress and therefore cannot be flattened by the roller leveler.

In this embodiment, a single piece of leveler equipment can be used as both the roller leveler and the tension leveler, which makes it possible to flatten the sheet material 1 in the above three modes. This makes it possible to select from these modes according to the thickness and yield stress of the sheet material, to perform leveling or flattening of a very wide range of sheet materials in terms of thickness and yield stress with the use of a single piece of equipment.

Figure 14:
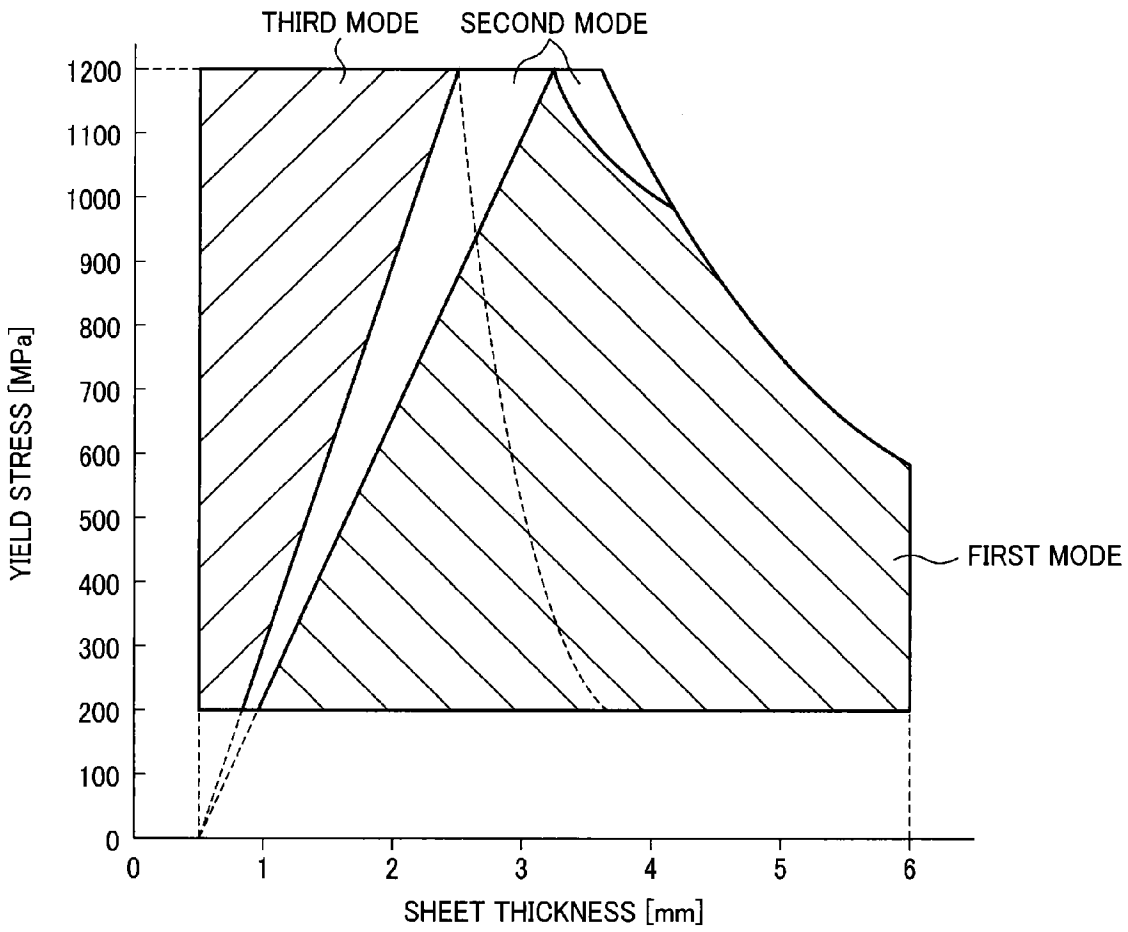
FIG. 14 is a diagram showing leveling ranges corresponding to first to third modes, where the abscissa indicates sheet thickness and the ordinate indicates yield stress.

An example is shown in FIG. 14. FIG. 14 is a diagram showing the leveling range in the case of stainless steel plates (SUS304) having a width of 1,600 mm, where the abscissa indicates sheet thickness and the ordinate indicates yield stress. This shows that the leveling range is significantly expanded by performing flattening in a mode selected from the first to third modes as compared to the case where flattening is performed by the roller leveler in the first mode only. In particular, the third mode using the tension leveler expands the leveling range to a range including a thinner and higher-in-yield-stress range and therefore makes it possible to perform flattening of a very thin sheet material having a high yield stress, that is, for example, a plate having a thickness of 0.5 mm and a yield stress of 1200 MPa. Note that the range of the third mode shown in FIG. 14 is the expanded part of the range as compared to the range achieved by using the roller leveler only. In actuality, the third mode can be used in the range that extends to the broken line. The modes may be changed according to the leveling range shown in FIG. 14 in actual operation.

As described above, according to this embodiment, the first roll cassette 20 having large-diameter, roller-leveler leveling rolls and the second roll cassette 30 having small-diameter, tension-leveler leveling rolls can be attached to and detached from the leveler body 10. When the first roll cassette 20 is attached, the roller leveler is formed. In this case, the leveler body 10 is used as a roller leveler by applying pressing force to the sheet material 1 without activating the bridle rolls. When the second roll cassette 30 is attached, the tension leveler is formed. In this case, the leveler body 10 is used as a tension leveler by applying pressing force to the sheet material 1 while activating the bridle rolls to apply tensile force to the sheet material 1. Accordingly, it is possible to selectively use the roller leveler and the tension leveler according to the thickness of the sheet material 1. In particular, it is possible to perform flattening of sheet material in the following three modes: a first mode, in which the first roll cassette 20 is attached to the leveler body 10 to form the roller leveler, and the sheet material 1 is flattened without applying tensile force to the sheet material by the bridle roll units 40*a* and 40*b* and without activating the pinch roll function of the bridle roll units 40*a* and 40*b*; a second mode, in which the first roll cassette 20 is attached to the leveler body 10 to form the roller leveler, and the sheet material 1 is flattened without applying tensile force to the sheet material 1 by the bridle roll units 40*a* and 40*b* while applying pulling force to the sheet material 1 by activating the pinch roll function of the bridle roll unit 40*b* on the delivery side; and a third mode, in which the second roll cassette 30 is attached to the leveler body 10 to form the tension leveler, and the sheet material 1 is flattened while applying tensile force to the sheet material 1 by the bridle roll units 40*a* and 40*b*. Accordingly, it is possible to select from these modes according to the thickness and yield stress of the sheet material 1, so that it is possible to perform leveling or flattening of a very wide range of sheet materials 1 in terms of thickness and yield stress with the use of a single piece of equipment.

Note that the present invention is not limited to the above embodiment and various modifications can be made. For example, while the equipment has been described, in which the upper leveling rolls are pressed toward the lower leveling rolls thereof, a configuration may be adopted, in which the lower rolls are pressed toward the upper rolls. The equipment, in which part of the components of the above embodiment are omitted without departing from the scope of the present invention, is also within the scope of the present invention.

DESCRIPTION OF REFERENCE NUMERALS

1; sheet material
10; leveler body
10*a*; driving mechanism
11; housing
12; upper frame
13; lower frame
14*a*, 14*b*; pressing cylinder (pressing mechanism)
15; casing
16; support portion
17; lift member
18; grip cylinder
18*a*; grip cylinder receptacle
19; hydraulic wedge
20; first roll cassette
20*a*, 30*a*; upper cassette
20*b*, 30*b*; lower cassette
21, 31; upper roll frame
22, 32; upper leveling roll
23, 33; upper intermediate roll
24, 34; upper backup roll
25, 35; lower roll frame
26, 36; lower leveling roll
27, 37; lower intermediate roll
28, 38; lower backup roll
29, 39; power transmitting mechanism
29*a*, 39*a*, 53; universal joint
29*b*, 39*b*; pinion nest
30; second roll cassette
40*a*, 40*b*; bridle roll unit
41, 42, 43; bridle roll
44, 45; pressing roll
46, 47; pinch roll
50; air blower
51; lift cylinder
52; motor
60; controller
64; wheel
65; rail base
65*a*; rail
100; leveler equipment

The invention claimed is:

1. Leveler equipment for flattening sheet material, comprising:

a leveler body for flattening the sheet material, the leveler body including a pressing mechanism and a housing;

a first roll cassette including upper and lower sets of roller-leveler leveling rolls, the first roll cassette being configured to be able to be attached to and detached from the leveler body; and a second roll cassette including upper and lower sets of tension-leveler leveling rolls, the second roll cassette being configured to be able to be attached to and detached from the leveler body, wherein:

the first roll cassette and the second roll cassette are interchangeable;

a roller leveler is formed when the first roll cassette is attached to the leveler body;

a tension leveler is formed when the second roll cassette is attached to the leveler body; and the leveler equipment further comprises a pair of bridle roll units provided on an entry side and a delivery side of the leveler body and each having bridle rolls;

a controller configured to, when the roller leveler is formed, control the leveler equipment so as to flatten the sheet material by causing the pressing mechanism to apply pressing force to the sheet material via the upper and lower sets of roller-leveler leveling rolls in a state where the sheet material is passed between the upper and lower sets of roller-leveler leveling rolls of the first roll cassette without applying tensile force to the sheet material via the bridle rolls, and configured to, when the tension leveler is formed, control the leveler equipment so as to flatten the sheet material by causing the pressing mechanism to apply pressing force to the sheet material via the upper and lower sets of tension-leveler leveling rolls in a state where the sheet material is passed between the upper and lower sets of tension-leveler leveling rolls of the second roll cassette while applying tensile force to the sheet material via the bridle rolls; and a driving mechanism for driving the upper and lower sets of roller-leveler leveling rolls and the upper and lower sets of tension-leveler leveling rolls, wherein the first roll cassette includes a first power transmitting mechanism for transmitting driving force from the driving mechanism to the upper and lower sets of roller-leveler leveling rolls, the second roll cassette includes a second power transmitting mechanism for transmitting driving force from the driving mechanism to the upper and lower sets of tension-leveler leveling rolls, and a reduction ratio of the first power transmitting mechanism is higher than a reduction ratio of the second power transmitting mechanism.

2. The leveler equipment according to claim 1, wherein the second roll cassette includes upper and lower sets of intermediate rolls provided on back sides of the upper and lower sets of tension-leveler leveling rolls, respectively, and the second power transmitting mechanism is configured to transmit the driving force from the driving mechanism to the upper and lower sets of intermediate rolls.

3. The leveler equipment according to claim 1, wherein:

at least one of the pair of bridle roll units that is provided on the delivery side has a pinch roll function; and the controller is configured to control the leveler equipment so as to flatten the sheet material in one of following modes:

a first mode, in which the first roll cassette is attached to the leveler body to form the roller leveler, and the sheet material is flattened by causing the pressing mechanism to apply pressing force to the sheet material via the upper and lower sets of roller-leveler leveling rolls in a state where the sheet material is passed between the upper and lower sets of roller-leveler leveling rolls of the first cassette without applying tensile force to the sheet material via the pair of bridle roll units and without activating the pinch roll function;

a second mode, in which the first roll cassette is attached to the leveler body to form the roller leveler, and the sheet material is flattened by causing the pressing mechanism to apply pressing force to the sheet material via the upper and lower sets of roller-leveler leveling rolls in a state where the sheet material is passed between the upper and lower sets of roller-leveler leveling rolls of the first roll cassette without applying tensile force to the sheet material via the pair of bridle roll units while applying pulling force to the sheet material by activating the pinch roll function of the at least one of the pair of bridle roll units that is provided on the delivery side; and a third mode, in which the second roll cassette is attached to the leveler body to form the tension leveler, and the sheet material is flattened by causing the pressing mechanism to apply pressing force to the sheet material via the upper and lower sets of tension-leveler leveling rolls in a state where the sheet material is passed between the upper and lower sets of tension-leveler leveling rolls of the second roll cassette while applying tensile force to the sheet material via the pair of bridle roll units.

4. The leveler equipment according claim 1, wherein a relation, $0.3D_{RL}<D_{TL}<0.6D_{RL}$, is satisfied, where $D_{RL}$ is a diameter of the roller-leveler leveling rolls of the first roll cassette and $D_{TL}$ is a diameter of the tension-leveler leveling rolls of the second roll cassette.

5. A sheet material flattening method of flattening sheet material, comprising:

changing a first roll cassette attached to a leveler body to a second roll cassette to form a tension leveler; and changing the second roll cassette attached to the leveler body to the first roll cassette to form a roller leveler in leveler equipment including:

the leveler body for flattening the sheet material, the leveler body including a pressing mechanism and a housing;

the first roll cassette having upper and lower sets of roller-leveler leveling rolls, the first roll cassette being configured to be able to be attached to and detached from the leveler body;

the second roll cassette having upper and lower sets of tension-leveler leveling rolls, the second roll cassette being configured to be able to be attached to and detached from the leveler body;

a pair of bridle roll units provided on an entry side and a delivery side of the leveler body and each having bridle rolls;

a driving mechanism for driving the upper and lower sets of roller-leveler leveling rolls and the upper and lower sets of tension-leveler leveling rolls, wherein the first roll cassette includes a first power transmitting mechanism for transmitting driving force from the driving mechanism to the upper and lower sets of roller-leveler leveling rolls, the second roll cassette includes a second power transmitting mechanism for transmitting driving force from the driving mechanism to the upper and lower sets of tension-leveler leveling rolls, and a reduction ratio of the first power transmitting mechanism is higher than a reduction ratio of the second power transmitting mechanism; and the sheet material flattening method further comprises:

when the roller leveler is formed by attaching the first roll cassette to the leveler body, flattening the sheet material by causing the pressing mechanism to apply pressing force to the sheet material via the upper and lower sets of roller-leveler leveling rolls in a state where the sheet material s passed between the upper and lower sets of roller-leveler leveling rolls of the first roll cassette without applying tensile force to the sheet material via the bridle rolls; and when the tension leveler is formed by attaching the second roll cassette to the leveler body, flattening the sheet material by causing the pressing mechanism to apply pressing force to the sheet material via the upper and lower sets of tension-leveler leveling rolls in a state where the sheet material is passed between the upper and lower sets tension-leveler leveling rolls of the second roll cassette while applying tensile force to the sheet material via the bridle rolls.

6. The sheet material flattening method. according to claim 5, wherein the at least one of the bridle roll units that is provided on the delivery side has a pinch roll function, and the sheet material is flattened in one of following modes that is selected according to thickness and yield stress of the sheet material:

a first mode, in which the first roll cassette is attached to the leveler body to form the roller leveler, and the sheet material is flattened by causing the pressing mechanism to apply pressing force to the sheet material via the upper and lower sets of roller-leveler leveling rolls in a state where he sheet material is passed between the upper and lower sets of roller-leveler leveling rolls of the first roll cassette without applying tensile force to the sheet material via the pair of bridle roll units and without activating the pinch roll function;

a second mode, in which the first roll cassette is attached to the leveler body to form the roller leveler, and the sheet material is flattened by causing the pressing mechanism to apply pressing force to the sheet material via the upper and lower sets of roller-leveler leveling rolls in a state where the sheet material is passed between the upper and lower sets of roller-leveler leveling rolls of the first roll cassette without applying tensile force to the sheet material via the pair of bridle roll units while applying pulling force to the sheet material by activating the pinch roll function of the at least one of the pair of bridle roll units that is provided or the delivery side; and a third mode, in which the second roll cassette is attached to the leveler body to form the tension leveler, and the sheet material is flattened by causing the pressing mechanism to apply pressing force to the sheet material via the upper and lower sets of tension-leveler leveling rolls in a state where the sheet material is passed between the upper and lower sets of tension-leveler leveling rolls of the second roll cassette while applying tensile force to the sheet material via the pair of bridle roll units.

* * * * *